US006246939B1

(12) United States Patent
Nozawa

(10) Patent No.: US 6,246,939 B1
(45) Date of Patent: Jun. 12, 2001

(54) METHOD AND APPARATUS FOR CONTROLLING ANGLES OF WORKING MACHINE

(75) Inventor: Yasuhiko Nozawa, Kawajima-machi (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/401,303

(22) Filed: Sep. 23, 1999

(30) Foreign Application Priority Data

Sep. 25, 1998 (JP) ..... 10-288859

(51) Int. Cl.[7] ..... G06F 19/00; G06G 7/00

(52) U.S. Cl. ..... 701/50; 37/411; 172/810; 340/686.1

(58) Field of Search ..... 701/50, 36; 37/411; 340/686.1; 172/810, 818, 819

(56) References Cited

U.S. PATENT DOCUMENTS

| | | | | |
|---|---|---|---|---|
| 5,359,516 | * | 10/1994 | Anderson | 701/50 |
| 5,461,803 | * | 10/1995 | Rocke | 37/443 |
| 5,735,066 | * | 4/1998 | Tochizawa et al. | 37/348 |
| 5,748,097 | * | 5/1998 | Collins | 340/686.1 |
| 5,799,419 | * | 9/1998 | Seo et al. | 37/348 |
| 5,875,701 | * | 3/1999 | Cobo et al. | 91/361 |
| 5,951,612 | * | 9/1999 | Sahm | 701/50 |
| 5,968,104 | * | 10/1999 | Egawa et al. | 701/50 |
| 5,995,893 | * | 11/1999 | Lee et al. | 701/50 |
| 6,058,342 | * | 5/2000 | Orbach et al. | 701/50 |

* cited by examiner

*Primary Examiner*—William A. Cuchlinski, Jr.
*Assistant Examiner*—Olga Hernandez
(74) *Attorney, Agent, or Firm*—Armstrong, Westerman, Hattori, McLeland & Naughton, LLP

(57) ABSTRACT

The invention provides a method and an apparatus for controlling angles of a working machine, which even unskilled operators can easily and efficiently perform in excavation and loading operation. For this purpose, the control apparatus includes an automatic excavation starting button (34), a boom angle detecting device (40), a bucket angle detecting device (41), an electromagnetic proportional control valve (20) for controlling the boom controlling valve (13) and the bucket controlling valve (14), and a controller (25) which starts an automatic excavation mode when inputting a start signal from the automatic excavation starting button (34), while outputting a control signal to cause the boom (3) to ascend at a predetermined speed to the electromagnetic proportional control valve (20), inputs the respective signals from the boom angle detecting device (40) and the bucket angle detecting device (41) to perform predetermined computation, and based on the previously stored automatic excavation mode, outputs a control signal to tilt the aforesaid bucket (4) at a predetermined angle in response to the ascending boom angle to the electromagnetic proportional control valve (20).

8 Claims, 7 Drawing Sheets

METHOD AND APPARATUS FOR CONTROLLING ANGLES OF WORKING MACHINE

TECHNICAL FIELD

The present invention relates to a control of a working machine of a front-end loader having a boom and a bucket at the front portion of a vehicle.

BACKGROUND ART

A method for excavation and loading by means of a bucket of a conventional front-end loader will be explained with reference to FIG. 1. FIG. 1 is a side view of a wheeled front-end loader. A front-end loader 1 has a working machine 5 equipped with a boom 3 and a bucket 4 at the front portion of a vehicle body 2. The front-end loader 1 mainly performs an operation of excavating a load 6 such as crushed rocks or earth and sand, and loading the same into a dump truck or the like. The operation of the working machine 5 of the front-end loader 1 includes a boom operation and a bucket operation. An operation of excavating and loading the load 6 into the bucket 4 is carried out by alternately performing a boom raising operation and a bucket tilting (in an ascending direction) operation while moving the front-end loader 1 toward a pile of the load 6.

In the above conventional excavation and loading operation by means of the bucket, an operator manipulates the boom operating lever and the bucket operating lever while moving the vehicle (the front-end loader) forward to alternately perform a boom raising movement and a bucket tilting movement, thereby loading the load into the bucket. In this situation, the operator controls the boom angle and the bucket angle by his or her intuitive knowledge. The relationship between the boom angle and the bucket angle differs depending on the earth quality of the load, loading operation conditions, or the like, and has a great influence on the operation efficiency. Accordingly, the operation requires a considerably high level of skill and experience, and the quantity of load loaded into the bucket varies according to the skill of an operator, thus reducing working efficiency with unskilled operators. However, there is a disadvantage that it is difficult to secure skilled operators. In addition, there arises a disadvantage that even skilled operators find it troublesome to alternately perform the boom raising operation and the bucket tilting operation, therefore causing fatigue and reducing efficiency.

SUMMARY OF THE INVENTION

In view of the above disadvantages, an object of the present invention is to provide a method and an apparatus for controlling angles of a working, machine, which even unskilled operators can easily and efficiently perform and offers skilled operators less fatigue in excavation and loading operations by means of a bucket.

A method for controlling angles of a working machine according to the present invention is a method for controlling angles of a working, machine of a front-end loader having a working machine including a boom attached to the front portion of a vehicle body to be ascendable and descendible, and a bucket attached to the front end portion of the boom to be vertically rotatable, and is characterized by including the steps of previously storing an automatic excavation mode expressing predetermined relationship of a bucket angle to a boom angle in excavation, during excavation, after manually setting the boom and the bucket at an automatic excavation starting position, starting an automatic excavation, and controlling the ascent of the boom and the tilt of the bucket based on the relationship between the boom angle and the bucket angle in the stored automatic excavation mode to thereby control each angle.

According to the above configuration, after the operator manually operates the working machine up to the automatic excavation starting position, the operator instructs a controller to start automatic excavation, thereby automatically tilting the bucket by predetermined amount corresponding to the boom ascending angle based on the automatic excavation mode previously stored. Consequently, excavation and loading operation becomes easy for the operator, and as a result, even unskilled workers can easily perform operations efficiently, while skilled workers can reduce fatigue because of the easier operation.

A first aspect of an apparatus for controlling angles of working machine according to the present invention is an apparatus for controlling angles of a working machine of a front-end loader including a boom attached to the front portion of a vehicle body to be ascendable and descendable, a bucket attached to the front end portion of the boom to be vertically rotatable, a boom controlling valve and a bucket controlling valve respectively controlling ascending and descending movements of the boom and tilting and dumping movements of the bucket based on operating signals from a boom operating lever and a bucket operating lever, and is characterized by including

- an automatic excavation starting button for instructing the start of automatic excavation by means of the boom and the bucket,
- a boom angle detecting means for detecting an ascent angle of the boom,
- a bucket angle detecting means for detecting a tilt angle of the bucket,
- an electromagnetic proportional control valve for inputting each control signal of the boom and the bucket, and controlling the boom controlling valve and the bucket controlling valve, and
- a controller which starts an automatic excavation mode when inputting a start signal from the automatic excavation starting, button,
- while outputting a control signal to cause the boom to ascend at a predetermined speed to the electromagnetic proportional control valve,
- inputs the respective signals from the boom angle detecting means and the bucket angle detecting means to perform predetermined computation, and based on the previously stored automatic excavation mode, outputs a control signal to tilt the bucket at a predetermined angle in response to the ascending boom angle to the electromagnetic proportional control valve.

According to the above configuration, the operator manipulates the automatic excavation starting button, thereby starting the automatic excavation mode. Thereafter, the controller causes the boom to automatically ascend, and automatically controls the bucket at the position of the bucket angle corresponding to the angle of the ascending boom based on the automatic excavation mode which is previously set and stored, thereby carrying out excavation and loading. Thus the operation of the excavation becomes extremely easy, thereby greatly reducing the fatigue of the operator.

A second aspect of an apparatus for controlling angles of a working machine according to the present invention is an apparatus for controlling angles of a working machine of a front-end loader including a boom attached to the front portion of a vehicle body to be ascendable and descendable, a bucket attached to the front end portion of the boom to be vertically rotatable, a boom controlling valve and a bucket controlling valve respectively controlling ascending and descending movements of the boom and tilting and dumping movements of the bucket based on operating signals from a boom operating lever and a bucket operating lever, and is characterized by including an automatic excavation starting button for instructing the start of automatic excavation by means of the boom and the bucket, a boom angle detecting means for detecting an ascent angle of the boom, a bucket angle detecting, means for detecting a tilt angle of the bucket, an electromagnetic proportional control valve for inputting each control signal of the boom and the bucket, and controlling the boom controlling valve and the bucket controlling valve, and a controller which starts an automatic excavation mode when inputting a start signal from the automatic excavation starting button, while outputting a control signal to cause the boom to ascend in accordance with the signal from the boom operating lever to the electromagnetic proportional control valve, inputs the respective signals from the boom angle detecting means and the bucket angle detecting means to perform predetermined computation, and based on the previously stored automatic excavation mode, outputs a control signal to tilt the bucket at a predetermined angle in response to the ascending boom angle to the electromagnetic proportional control valve.

According to the above configuration, the operator manipulates the automatic excavation starting button to start the automatic excavation mode, and manipulates the boom operating lever to cause the boom to ascend. When the boom reaches the position at a predetermined angle as a result of the boom ascending, the bucket automatically tilts at a predetermined angle based on the automatic excavation mode previously set, thus repeating the automatic control of the tilt angle. Thereby the excavation and loading operation are made easier, and the operations can be carried out at the operator's will, therefore improving the operability.

A third configuration of an apparatus for controlling angles of a working machine is an apparatus for controlling angles of a working machine of a front-end loader including a boom attached to the front portion of a vehicle body to be ascendable and descendable, a bucket attached to the front end portion of the boom to be vertically rotatable, a boom controlling valve and a bucket controlling valve respectively controlling ascending and descending movements of the boom, and tilting and dumping movements of the bucket based on operating signals from a boom operating lever and a bucket operating lever, and is characterized by including an automatic excavation starting button for instructing the start of automatic excavation by means of the boom and the bucket, a boom angle detecting, means for detecting, an ascent angle of the boom, an electromagnetic proportional control valve for inputting each control signal of the boom and the bucket, and controlling the boom controlling valve and the bucket controlling valve, and a controller which starts an automatic excavation mode when inputting a start signal from the automatic excavation starting button, while outputting a control signal to cause the boom to ascend in accordance with the signal from the boom operating lever to the electromagnetic proportional control valve, inputs the signal from the boom angle detecting means to perform predetermined computation, and based on the previously stored automatic excavation mode, outputs a control signal to tilt the bucket for a predetermined period of time in response to the ascending boom angle to the electromagnetic proportional control valve.

According to the above configuration, the bucket tilting movement in the automatic excavation mode is controlled with respect to time, therefore making the configuration simpler without requiring the bucket angle detecting means, and also making the control software simpler. In addition, the operator can easily carry out excavation and loading operations.

Further, it may be suitable to include a kick down switch for shifting the traveling speed from the forward second gear to the forward first gear. According to the above configuration, the kick down switch is provided in addition to the automatic excavation starting button. As a result, in the excavation and loading operations, it is made possible to travel with the forward second gear, and to manipulate the kick down switch simultaneously with the start of excavation to switch to the forward first gear, thereby carrying out the automatic excavation while increasing the driving force. Consequently, the efficiency of the excavation and loading operations can be improved.

Furthermore, the apparatus may include a mode selecting means which is connected to the controller, and allows the selection of any one of the automatic excavation modes in which at least one of the following is previously set: the bucket tilt angle corresponding to a predetermined boom ascent angle, and the bucket tilt period of time corresponding to the predetermined boom ascent angle.

According to the above configuration, one of a plurality of kinds of automatic excavation modes can be selected at will with the mode selecting means, therefore making it possible to select the excavation mode that is the most suitable for the earth quality, the operation conditions, and the like, and increasing operation efficiency.

Further, the apparatus may include a kick down switch for shifting the traveling speed from the forward second gear to the forward first gear, and a mode selecting means which is connected to the controller, and allows the selection of any one of the automatic excavation modes in which at least one of the following is previously set: the bucket tilt angle corresponding to a predetermined boom ascent angle, and the bucket tilt period of time corresponding to the predetermined boom ascent angle.

According to the above configuration, the excavation mode that is the most suitable for earth quality, operation conditions, and the like can be selected, and the driving force during excavation can be increased by manipulating the kick down switch, therefore further increasing the operation efficiency.

Furthermore, the apparatus may include an engine speed detector for detecting engine speed and outputting the detection signal to the controller, and the controller may select the automatic excavation mode corresponding to the magnitude of a load determined based on the engine speed detection signal out of the stored automatic excavation modes, and may control the movement of the bucket based on the selected excavation mode.

According to the above configuration, the magnitude of a load is determined based on the engine speed detected by the engine speed detector, thereby making it possible to select the automatic excavation mode that is the most efficient for the load. Thus the excavation correspondent to a load can be carried out, thereby increasing the operation efficiency.

BEST MODE FOR CARRYING OUT THE INVENTION

Preferred embodiments of a method and apparatus for controlling angles of a working machine according to the present invention will he described in detail below with reference to the attached drawings.

Figure 1:
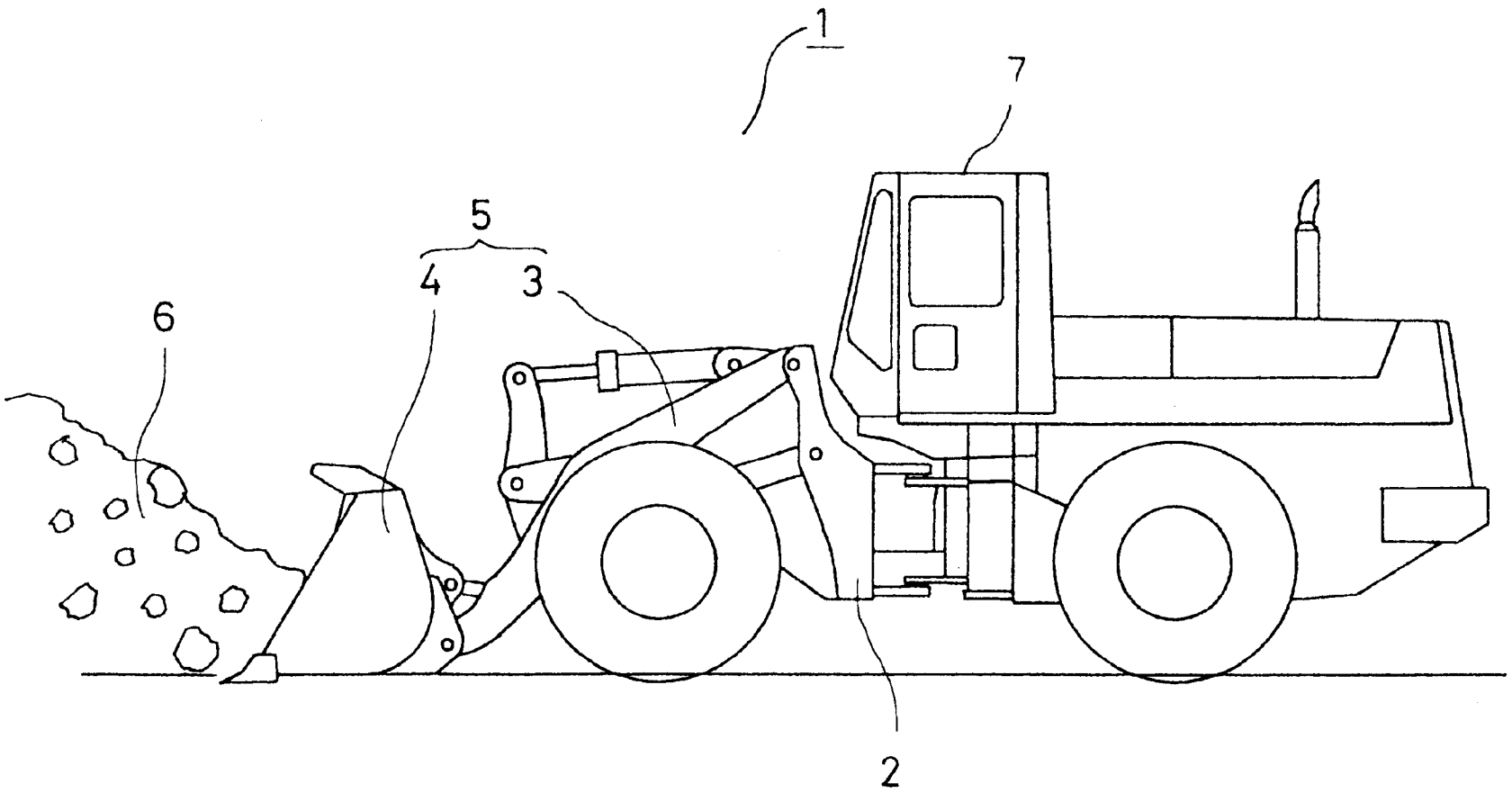
FIG. 1 PRIOR ART
FIG. 1 is a side view of a front-end loader according to a prior art.

FIG. 1 shows an ordinary front-end loader 1 to which the method and apparatus for controlling the angles of the working machine according, to the present invention are applied. The explanation will be made below with the wheeled front-end loader 1 being cited as an example. The front-end loader 1 has a working machine 5 equipped with a boom 3 attached at the front portion of a travelable vehicle body 2 to be ascendable and descendable and a bucket 4 attached at the front end portion of the boom 3 to be vertically rotatable. The boom 3 and the bucket 4 are operated by means of respective operating levers provided in a driver's cab mounted on the vehicle body 2.

Figure 2:
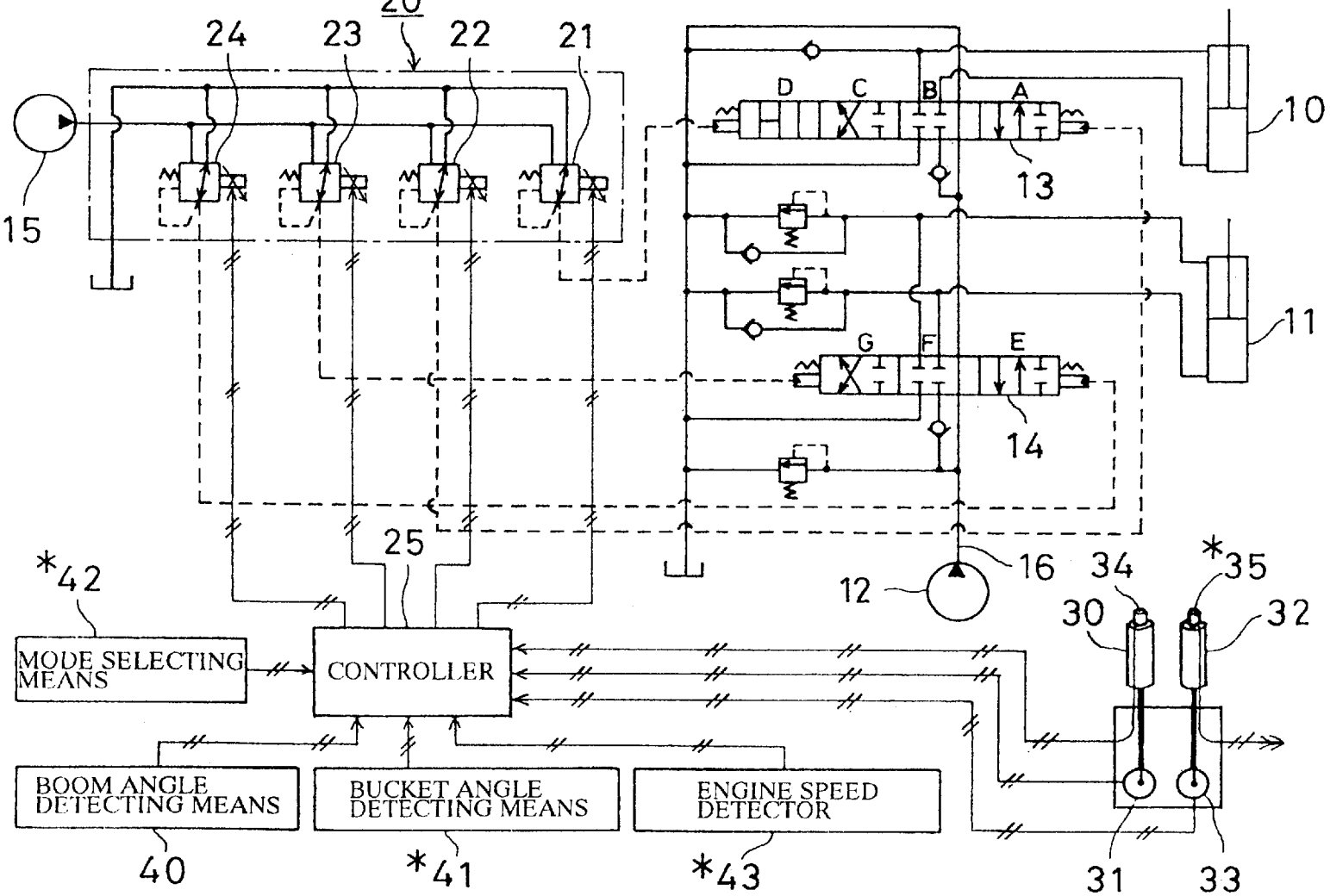
FIG. 2 is a control system diagram of an apparatus for controlling angles of a working machine according to the present invention.

FIG. 2 is a control system diagram of the apparatus for controlling the angles of the working machine 5. Pilot hydraulic type boom controlling valve 13 and bucket controlling valve 14, which are attached onto a discharge, circuit 16 of a working machine hydraulic pump 12, are respectively connected to a boom cylinder 10 and a bucket cylinder 11 to compose a tandem circuit. The boom controlling valve 13 is a four position change-over valve having a position A (boom ascend), a position B (neutral), a position C (boom descend), and a position D (float). The bucket controlling valve 14 is a three position change-over valve having a position E (tilt), a position F (neutral), and a position G (dump). Pilot pressure receiving portions of the boom controlling valve 13 and the bucket controlling valve 14 are respectively connected to a pilot pump 15 via an electromagnetic proportional control valve 20.

The electromagnetic proportional control valve 20 is composed of a boom lowering electromagnetic proportional control valve 21, a boom raising electromagnetic proportional valve 22, a bucket dumping electromagnetic proportional control valve 23, and a bucket tilting electromagnetic proportional control valve 24. The boom lowering electromagnetic proportional control valve 21 and the boom raising electromagnetic proportional control valve 22 are connected to each of the pilot pressure receiving portions of the boom controlling valve 13. The bucket dumping electromagnetic control valve 23 and the bucket tilting electromagnetic control valve 24 are connected to each of the pilot pressure receiving portions of the bucket control valve 14. A solenoid command element of each of the electromagnetic proportional control valves 21, 22, 23, and 24 inputs each command signal from a controller 25.

A first potentiometer 31 for detecting a boom manipulated variable is attached to a boom operating lever 30, and a second potentiometer 33 for detecting a bucket manipulated variable is attached to a bucket operating lever 32, so that the respective detecting signals are inputted into the controller 25. The boom operating lever 30 is provided with an automatic excavation starting button 34, and its excavation starting signal is inputted in the controller 25. The bucket operating lever 32 is provided with a kick down switch 35 for enabling gearshift from the forward second gear to the forward first gear without manipulating a gear shit lever (not illustrated). The kick down switch 35 is connected to a gear shift control unit (not illustrated). The controller 25 is connected to a boom angle detecting means 40, a bucket angle detecting means 41, a mode selecting means 42 and an engine speed detector 43.

In FIG. 2, the kick down switch 35, the bucket angle detecting means 41, the m ode selecting means 42, and the engine speed detector 43, which are marked with the asterisks (*), may not be used depending on the configuration of the system. Further, the kick down switch 35 may also be used as the automatic excavation starting, button 34.

Next, the operation will be explained based on FIG. 2. When an operator manipulates the boom operating lever 30, or the bucket operating lever 32, the controller 25 inputs the manipulated variable signal of each of the operating levers 30 and 32 from the first potentiometer 31, or the second potentiometer 33, and outputs a working, machine speed control command corresponding to the manipulated variable signal to each of the electromagnetic proportional control valves 21, 22, 23, and 24. Each of the electromagnetic proportional control valves 21, 22, 23, and 24 outputs the pilot oil pressure corresponding to the magnitude of the working machine speed control command to the corresponding pilot pressure receiving portion of the boom controlling valve 13 or the bucket controlling valve 14. The above output causes the boom cylinder 10 or the bucket cylinder 11 to move in the corresponding, direction at the speed corresponding to the pilot oil pressure.

Meanwhile, on receiving input of the excavation starting signal from the automatic excavation starting button 34, the controller 25 starts automatic excavation, and receives input of each signal from the boom angle detecting means 40, the bucket angle detecting means 41, the mode selecting means 42, and the engine speed detector 43. Based on each signal inputted, the controller 25 performs predetermined computation described later, outputs a working machine speed control command to each solenoid command element of the electromagnetic proportional control valve 20 to control the boom angle and the bucket angle, thereby carrying out automatic excavation. At this time, by manipulating the kick down switch 35 to change the vehicle speed from the forward second gear to the forward first gear, the driving force increases, and thus the excavating efficiency increases.

The automatic excavation starting button 34 also used as the kick down switch 35 makes it possible to simultaneously start automatic excavation and kick down, thereby enabling an excavating operation to be carried out more easily and efficiently.

Figure 3:
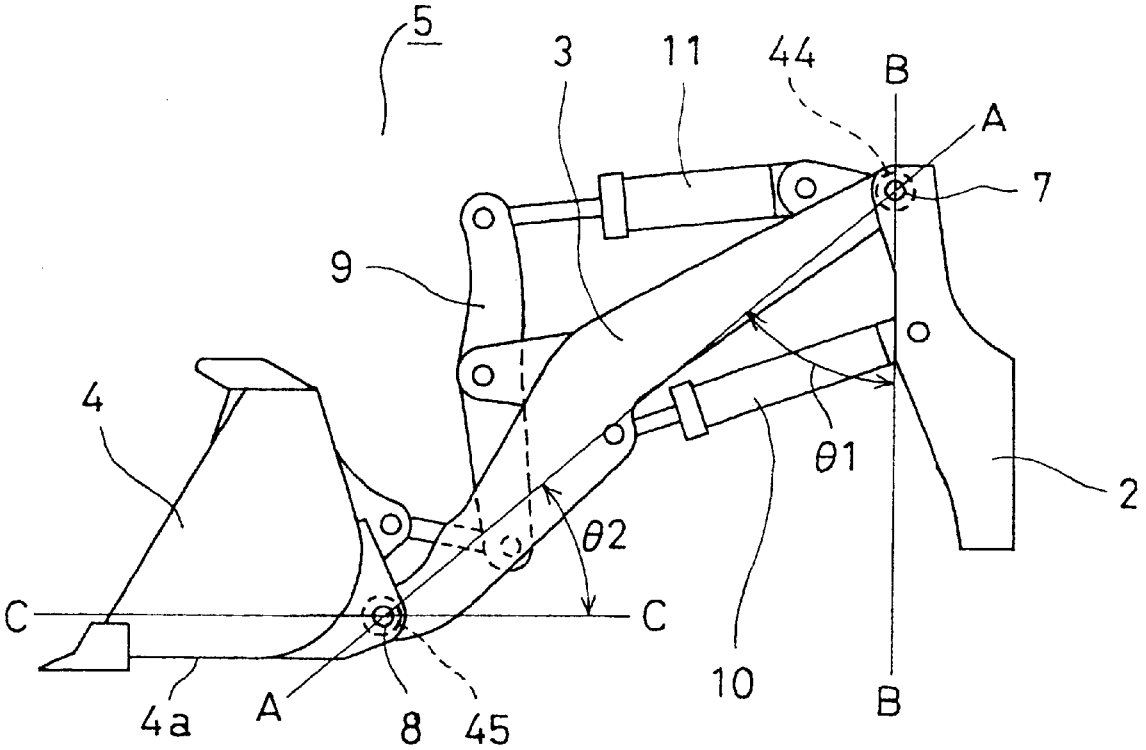
FIG. 3 is an explanatory view of a boom angle and a bucket angle of the working machine according to the present invention.

Next, based on FIG. 3, detection of the boom angle and the bucket angle by means of the boom angle detecting means 40 and the bucket angle detecting means 41 will be explained. FIG. 3 is a side view of the working machine 5 of the front-end loader.

The base end portion of the boom 3 is rotatably attached to the vehicle body 2 with a pin 7, and the vehicle body 2 and the boom 3 are connected by means of the boom cylinder 10. The extension of the boom cylinder 10 causes the boom 3 to rotate around the pin 7 an d to ascend, and the retraction of the boom cylinder 10 causes the boom 3 to descend. The bucket 4 is rotatably attached to the front end portion of the boom 3 with a pin 8, and the bucket 4 and the boom 3 are connected by means of the bucket cylinder 11 with a link 9 between them. The extension of the bucket cylinder 11 causes the bucket 4 to tilt, and the contraction thereof causes the bucket 4 to dump.

In the above working machine 5, the boom angle is expressed by an angle θ1 formed by the line A—A connectings the pins 7 and 8, and the vertical line B—B passing through the pin 7. The bucket angle is expressed by an angle θ2 formed by the line A—A and the line C—C passing, through the pin 8 and parallel to a bottom surface 4*a* of the bucket 4. Thus, when the boom 3 ascends, the boom angle θ1 increases, and when the bucket 4 tilts, the bucket angle θ2 increases. As an example of the boom angle detecting means 40, a third potentiometer 44 is attached to the area around the pin 7 at the base end portion of the boom 3. Further, as an example of the bucket angle detecting means 41, a fourth potentiometer 45 is attached to the area around the pin 8 being the center of rotation of the bucket 4.

Subsequently, based on FIG. 4 and FIG. 5, the method for controlling the angles of the working machine according to the first embodiment of the present invention will he explained. In the present invention, the boom angle and the bucket angle are controlled with predetermined relationship being maintained between them, thereby carrying out excavation in various excavation modes.

Figure 4:
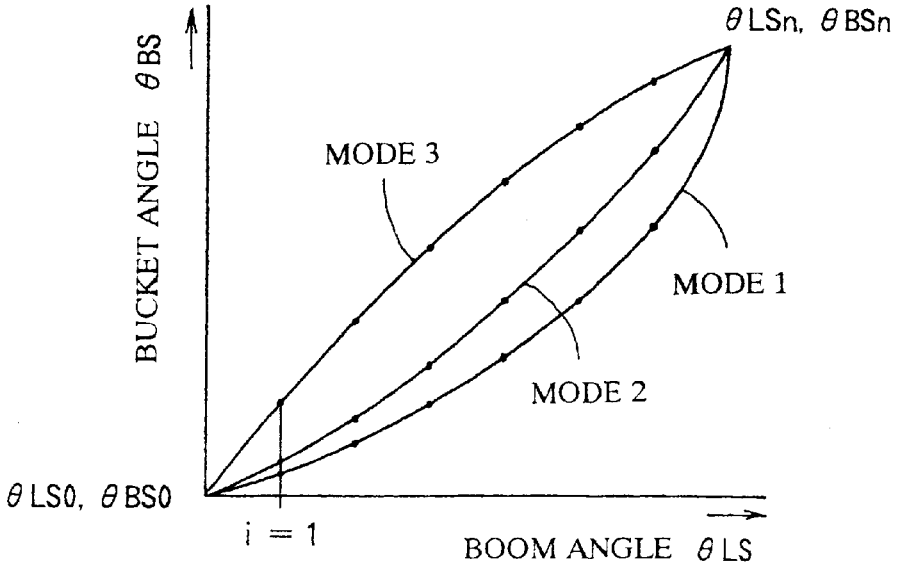
FIG. 4 is a graph showing an excavation mode of a first embodiment according to the present invention.

FIG. 4 is a graph showing an example of the relationship between the boom angle and the bucket angle in each excavation mode according to the first embodiment. The horizontal axis shows a boom angle θLS and the vertical axis shows a bucket angle θBS. The curved lines show three kinds of modes: a mode 1, a mode 2, and a mode 3 respectively. The points set on each mode curved line, corresponding to steps i of the processing parameter which is used in the computation processing by the controller 25. The step i shall vary from 0 to n. The magnitude of the load during excavation is determined by the engine speed, therefore making it possible to set the excavation mode corresponding to a load by changing the excavation mode in each predetermined range of the engine speed. The form, the number of types, and the step of each curved line shown in FIG. 4 are optimally set to conform to earth quality, operational conditions, and the like.

Figure 5:
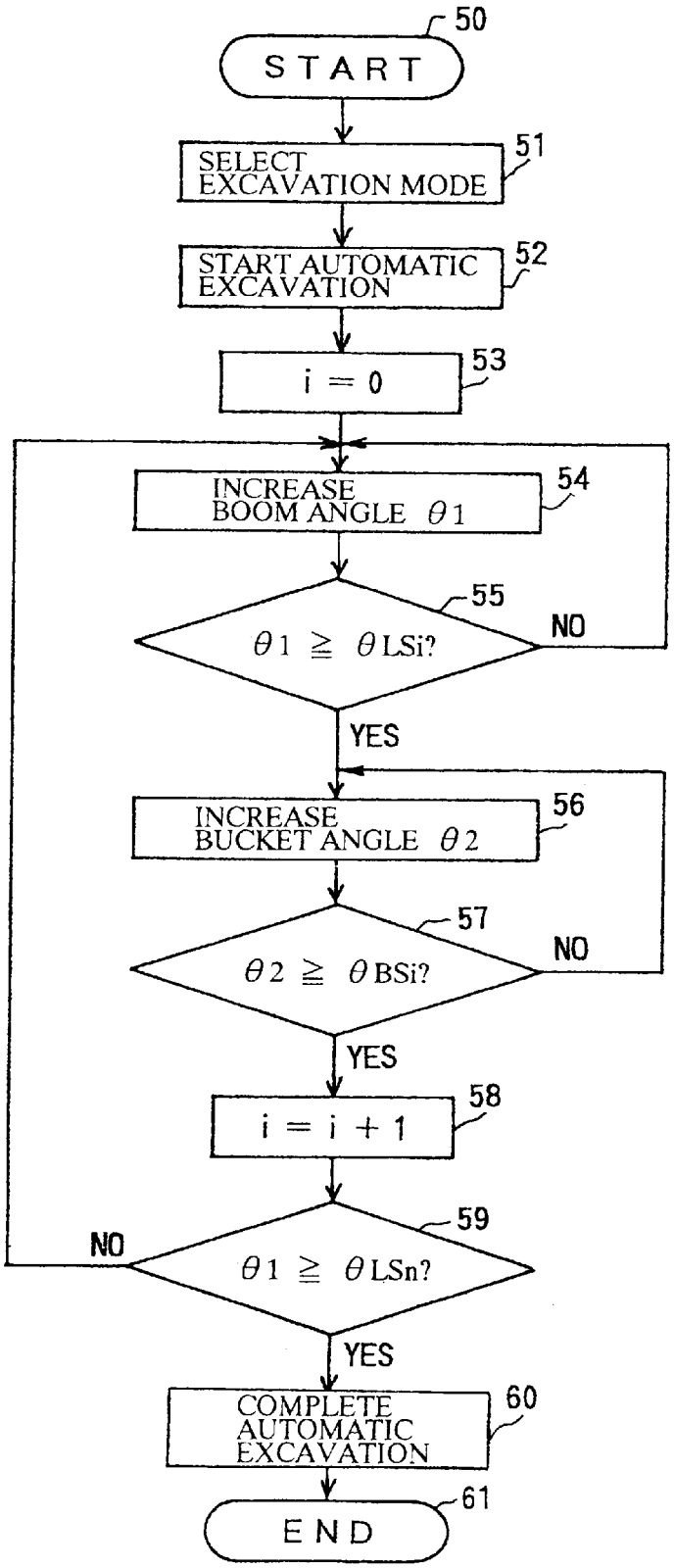
FIG. 5 is a flowchart of a control method of the first embodiment according to the present invention.

FIG. 5 is a computation processing flowchart of the controller 25 in the first embodiment, and the method for controlling the angles of the working machine is explained based on FIG. 5. Here, it is assumed that the controller 25 stores the curved line of each excavation mode shown in FIG. 4.

(1) In step 51, the operator instructs the controller 25 with the optimal excavation mode in view of the earth quality, working conditions, etc. by means of the mode selecting means 42. The controller 25 selects the excavation mode instructed by the operator from the stored excavation modes. If the engine speed detector 43 is provided, the controller 25 inputs a signal from the engine speed detector 43, and selects the excavation mode corresponding to the load.

(2) In step 52, the operator manipulates the automatic excavation starting button 34 to give the controller 25 the instruction to start the automatic excavation.

(3) In step 53, the controller 25 starts the automatic excavation from the step i=0.

(4) In step 54, the controller 25 outputs a control signal to the boom raising electromagnetic proportional control valve 21 to start raising the boom 3 and increase the boom angle θ1.

(5) In step 55, the controller 25 determines whether the boom angle θ1≧θLSi by computation based on the excavation mode. If it is NO, a command is given to return to step 54, and if it is YES, a command is given to go to step 56.

(6) In step 56, the controller 25 outputs a control signal to the bucket tilting electromagnetic proportional control valve 24 based on the excavation modes of the first embodiment shown in FIG. 4 to tilt the bucket 4. As a result, the bucket angle θ2 increases.

(7) In step 57, the controller 25 determines whether θ2≧θBSi by computation based on the excavation mode. If it is NO, a command is given to return to step 56, and if it is YES, a command is given to proceed to step 58.

(8) In step 58, a command is given to proceed to the next step i=i+1.

(9) In step 59, the controller 25 determines whether the final step is reached, that is, whether the boom angle θ1≧θ LSn by computation. If it is NO, a command is given to return to step 54 to repeat the above steps.

(10) In step 59, if it is YES, the automatic excavation is completed in step 60 to shift to the ordinary manual mode.

Up to this point, the first automatic excavation and loading a operation of the bucket 4 are finished, and the automatic excavation and loading operation of the next time or later are started again from the excavation mode selection. According to the above method, once the operator manipulates the automatic excavation starting button 34, the excavation and loading, of the bucket 4 is automatically carried out, therefore making the operation extremely easy, and making it possible for even unskilled workers to easily carry out.

Next, a second embodiment according to the present invention will be explained with reference to FIG. 6 and FIG. 7.

Figure 6:
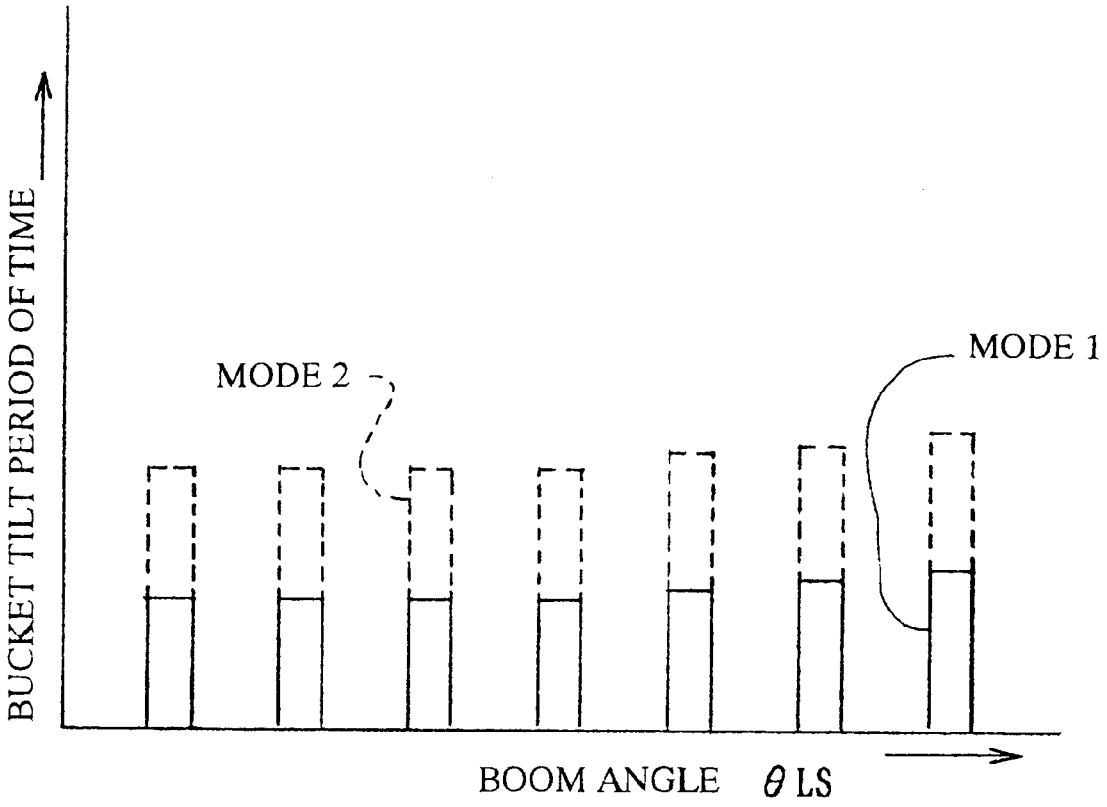
FIG. 6 is a graph showing an excavation mode of a second embodiment according to the present invention.

FIG. 6 is a graph showing an example of relationship between the boom angle and the bucket angle in an excavation mode according to the second embodiment. The horizontal axis shows the boom angle θLS, and the vertical axis shows a bucket tilt driving period of time (hereinafter, called the bucket tilt period of time) corresponding to the boom angle θLS. FIG. 6 shows two kinds of modes, the mode 1 and the mode 2, the bucket tilt period of time is set for each step i of the aforesaid processing parameter corresponding to each predetermined range of the boom angle θLS. It should be noted that the form, the number of kinds, the steps, shown in FIG. 6 are optimally set in accordance with the earth quality, working conditions, and the like, and are previously stored in the controller 25.

Figure 7:
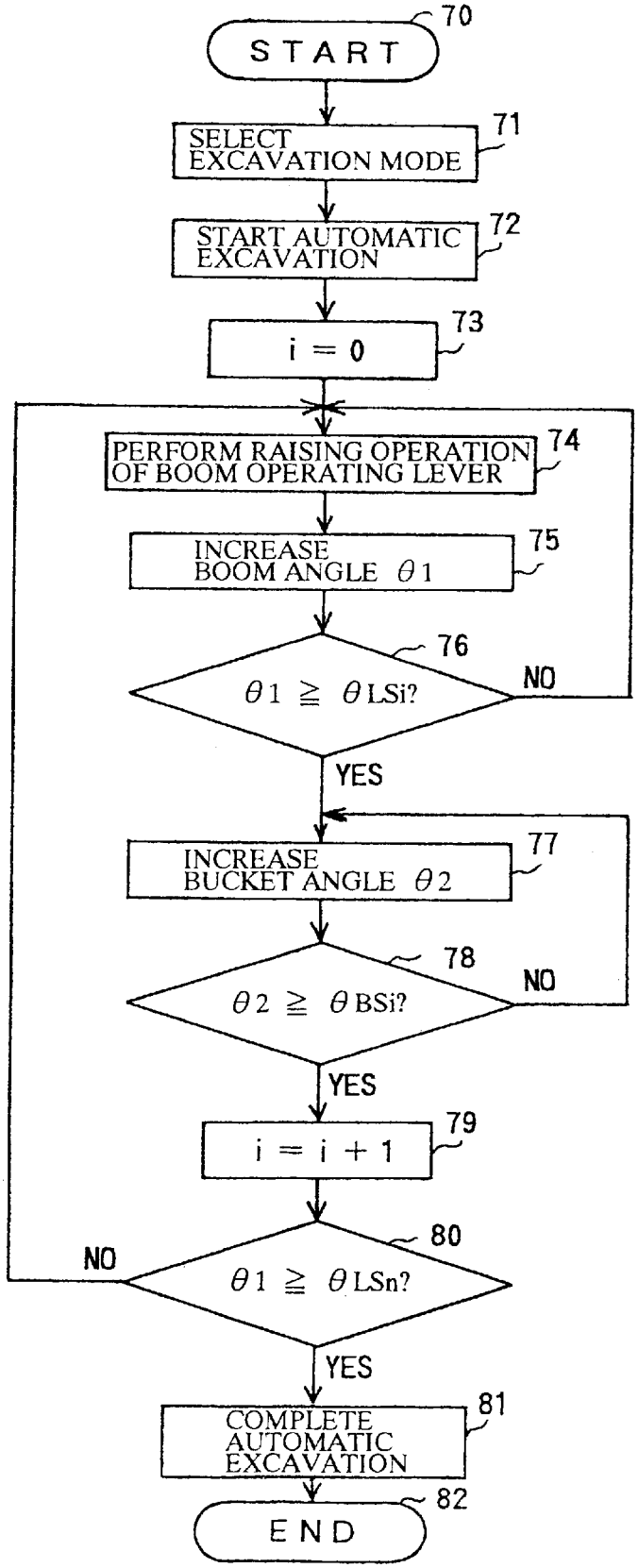
FIG. 7 is a flowchart of a control method of the second embodiment according to the present invention.

FIG. 7 is a computation processing flowchart of the controller 25 in the second embodiment, a method for controlling the angles according to the second embodiment will be explained based on FIG. 7. Here, the controller 25 shall store characteristic data (data showing the relationship between the boom angle and the bucket tilt period of time) of each excavation mode shown in FIG. 6.

(1) In step 71, the operator gives an instruction as to the selected excavation mode to the controller 25 by means of the mode selecting means 42. The controller 25 selects the instructed excavation mode out of the stored excavation modes. If the engine speed detector 43 is provided, the controller 25 inputs a signal from the engine speed detector 43, and selects the excavation mode corresponding to the load.

(2) In step 72, the operator gives the controller 25 an instruction to start the automatic excavation with the automatic excavation starting button 34.

(3) In step 73, the controller 25 starts the automatic excavation from the step i=0.

(4) In step 74, the operator manipulates the operating lever 30 to perform a raising, operation.

(5) In step 75, the boom 3 ascends, and the boom angle θ1 increases.

(6) In step 76, the controller 25 determines whether the boom angle θ1≧θLSi by computation based on the excavation mode. If it is NO, a command is given to return to step 74, and if it is YES, a command is given to go to step 77.

(7) In step 77, the controller 25 outputs a control signal to the bucket tilting electromagnetic proportional control valve 24 based on the excavation modes of the first embodiment shown in FIG. 4 to tilt the bucket 4. As a result, the bucket angle θ2 increases.

(8) In step 78, the controller 25 determines whether θ2≧θBSi by computation based on the excavation mode. If it is NO, a command is given to return to step 77, and if it is YES, a command is given to proceed to step 79.

(9) In step 79, a command is given to proceed to the next step i=i+1.

(10) In step 80, the controller 25 determines whether the final step is reached, that is, whether the boom angle θ1≧θLSn by computation. If it is NO, a command is given to return to step 74 to repeat the above steps.

(11) In step 80, if it is YES, the automatic excavation is completed in step 81 to shift to the ordinary manual mode.

According to the above method, the operator performs the boom raising operation of his or her own will, thereby making it possible to carry out the operation in accordance with the circumstances, and therefore the operation can be expected to be performed with higher efficiency.

Figure 8:
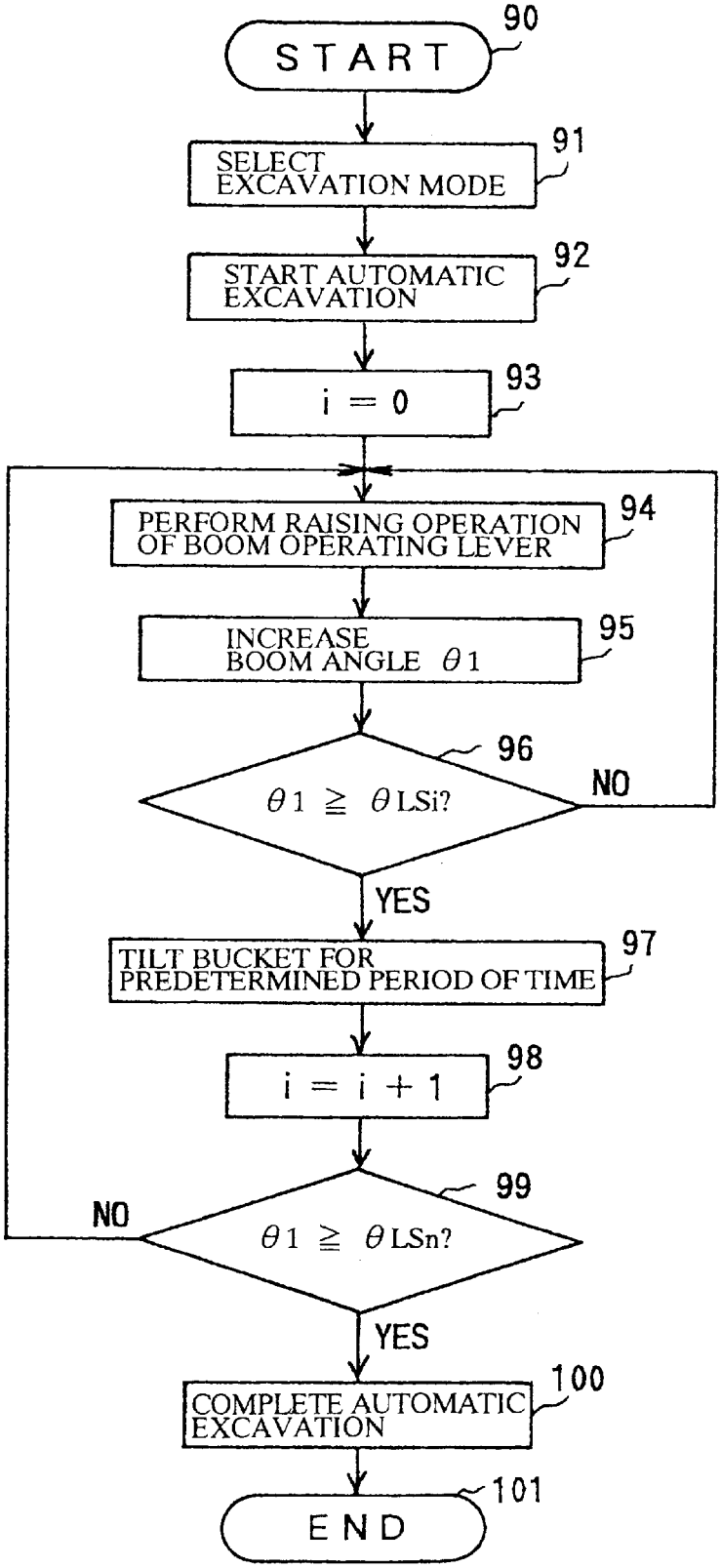
FIG. 8 is a flowchart of a control method of a third embodiment according to the present invention.

Next, a third embodiment according to the present invention will be explained. FIG. 8 is a flowchart of a method for controlling the angles of the working machine according to the third embodiment. Here, the controller 25 shall store characteristic data of the same excavation mode as in the second embodiment shown in FIG. 6.

(1) In step 91, the operator gives an instruction as to the excavation mode to the controller 25 by means of the mode selecting means 42. The controller 25 selects the excavation mode instructed by the operator from the stored excavation modes.

(2) In step 92, the operator manipulates the automatic excavation starting, button 34 to give the controller 25 an instruction to start the automatic excavation.

(3) In step 93, the controller 25 starts the automatic excavation from the step i=0.

(4) In step 94, the operator manipulates the boom operating lever 30 to perform a raising operation.

(5) In step 95, the boom 3 ascends, and the boom angle θ1 increases.

(6) In step 96, the controller 25 determines whether the boom angle θ1≧θLSi by computation based on the excavation mode. If it is NO, a command is given to return to step 94, and if it is YES, a command is given to go to step 97.

(7) In step 97, the controller 25 tilts the bucket 4 for a predetermined period of time based on the excavation modes of the second embodiment shown in FIG. 6.

(8) In step 98, a command is given to proceed to the next step i=i+1.

(9) In step 99, the controller 25 determines whether the final step is reached, that is, whether the boom angle θ1>θLSn by computation. If it is NO, a command is given to return to step 94 to repeat the above steps.

(10) In step 99, if it is YES, the automatic excavation is completed in step 100 to shift to the ordinary manual mode.

According to the above method, the tilt of the bucket 4 is set by a period of time, therefore making the bucket tilt period of time constant irrespective of the magnitude of the load. Consequently, the excavation and loading operation can be carried out in a constant rhythm, thus enabling, to carry out the operation efficiently. It should be noted that in the third method, the bucket tilt is not performed by the angle control, therefore eliminating the need of the bucket angle detecting means 41 in FIG. 2.

The other embodiments will be explained below.

(1) In FIG. 2, the boom controlling valve 13 and the bucket controlling valve 14 compose the tandem circuit, but it may be suitable to compose a parallel circuit (not illustrated) to make it possible to simultaneously operate the boom 3 and the bucket 4.

(2) In FIG. 2, when only one kind of excavation mode is used, the mode selecting means 42 becomes unnecessary, thereby eliminating the excavation mode selecting step in each of the above flowcharts.

(3) In FIG. 3, the third potentiometer 44 and the fourth potentiometer 45 for detecting the boom angle θ1 and the bucket angle θ2 may be stroke sensors of the boom cylinder 10 and the bucket cylinder 11. Alternatively, valve opening period of times of the boom controlling valve 13 and the bucket controlling valve 14 may be used instead of the boom angle θ1 and the bucket angle θ2.

(4) In the above control methods and control apparatus, an automatic excavation canceling means not illustrated (for example, an automatic excavation canceling switch) may be provided to cancel the automatic excavation during an automatic excavating operation, thereby enabling to shift to the manual mode. In this control method, the bucket operating lever 32 is not used. Consequently, the automatic excavation canceling means may be configured so that the automatic excavation is canceled when the bucket operating lever 32 is manipulated during an automatic excavating operation.

(5) In the above control methods, the operation signals by the operator at the time of the first excavation and loading may be stored in the controller as a teaching mode, which is played back at the second time or later, thereby automatically carrying out excavation and loading.

What is claimed is:

1. A method for controlling angles of a working machine of a front-end loader having a working machine including a boom (3) attached to the front portion of a vehicle body to be ascendable and descendable, and a bucket (4) attached to the front end portion of said boom (3) to be vertically rotatable, comprising the steps of:

previously storing an automatic excavation mode expressing predetermined relationship of a bucket angle to a boom angle in excavation;

during excavation, after manually setting said boom (3) and said bucket (4) at an automatic excavation starting position, starting an automatic excavation, and controlling the ascent of said boom (3) and the tilt of said bucket (4) based on the relationship between the boom angle and the bucket angle in said stored automatic excavation mode to thereby control each angle.

2. An apparatus for controlling angles of a working machine of a front-end loader including a boom (3) attached to the front portion of a vehicle body to be ascendable and descendable, a bucket (4) attached to the front end portion of said boom (3) to be vertically rotatable, a boom controlling valve (13) and a bucket controlling valve (14) respectively controlling ascending and descending movements of said boom (3) and tilting and dumping, movements of said bucket (4) based on operating signals from a boom operating lever (30) and a bucket operating lever (32), said apparatus comprising:

an automatic excavation starting button (34) for instructing the start of automatic excavation by means of said boom (3) and said bucket (4);

a boom angle detecting means (40) for detecting an ascent angle of said boom (3);

a bucket angle detecting means (41) for detecting a tilt angle of said bucket (4);

an electromagnetic proportional control valve (20) for inputting each control signal of said boom (3) and said bucket (4), and controlling said boom controlling valve (13) and said bucket controlling valve (14); and a controller (25) which starts an automatic excavation mode when inputting a start signal from said automatic excavation starting button (34), while outputting a control signal to cause said boom (3) to ascend at a predetermined speed to said electromagnetic proportional control valve (20), inputs the respective signals from said boom angle detecting means (40) and said bucket angle detecting means (41) to perform predetermined computation, and based on the previously stored automatic excavation mode, outputs a control signal to tilt said bucket (4) at a predetermined angle in response to the ascending boom angle to said electromagnetic proportional control valve (20).

3. An apparatus for controlling angles of a working machine of a front-end loader including a boom (3) attached to the front portion of a vehicle body to be ascendable and descendable, a bucket (4) attached to the front end portion of said boom (3) to be vertically rotatable, a boom controlling valve (13) and a bucket controlling valve (14) respectively controlling ascending and descending movements of said boom (3) and tilting and dumping movements of said bucket (4) based on operating signals from a boom operating lever (30) and a bucket operating lever (32), said apparatus comprising:

an automatic excavation starting button (34) for instructing the start of automatic excavation by means of said boom (3) and said bucket (4);

a boom angle detecting means (40) for detecting an ascent angle of said boom (3);

a bucket angle detecting means (41) for detecting a tilt angle of said bucket (4);

an electromagnetic proportional control valve (20) for inputting each control signal of said boom (3) and said bucket (4), and controlling said boom controlling valve (13) and said bucket controlling valve (14); and a controller (25) which starts an automatic excavation mode when inputting a start signal from said automatic excavation starting button (34), while outputting a control signal to cause said boom (3) to ascend in accordance with the signal from said boom operating lever (30) to said electromagnetic proportional control valve (20), inputs the respective signals from said boom angle detecting means (40) and said bucket angle detecting means (41) to perform predetermined computation, and based on the previously stored automatic excavation mode, outputs a control signal to tilt said bucket (4) at a predetermined angle in response to the ascending, boom angle to said electromagnetic proportional control valve (20).

4. An apparatus for controlling angles of a working machine of a front-end loader including a boom (3) attached to the front portion of a vehicle body to be ascendable and descendable, a bucket (4) attached to the front end portion of said boom (3) to be vertically rotatable, a boom controlling valve (13) and a bucket controlling valve (14) respectively controlling ascending and descending movements of said boom (3) and tilting and dumping movements of said bucket (4) based on operating signals from a boom operating lever (30) and a bucket operating lever (32), said apparatus comprising:

an automatic excavation starting button (34) for instructing the start of automatic excavation by means of said boom (3) and said bucket (4);

a boom angle detecting, means (40) for detecting an ascent angle of said boom (3);

an electromagnetic proportional control valve (20) for inputting each control signal of said boom (3) and said bucket (4), and controlling said boom controlling valve (13) and said bucket controlling valve (14); and a controller (25) which starts an automatic excavation mode when inputting a start signal from said automatic excavation starting button (34), while outputting a control signal to cause said boom (3) to ascend in accordance with the signal from said boom operating lever (30) to said electromagnetic proportional control valve (20), inputs the signal from said boom angle detecting means (40) to perform predetermined computation, and based on the previously stored automatic excavation mode, outputs a control signal to tilt said bucket (4) for a predetermined period of time in response to the ascending boom angle to said electromagnetic proportional control valve (20).

5. The apparatus for controlling the angles of the working machine in accordance with any one of claim 2 to claim 4, further comprising:

a kick down switch (35) for shifting the traveling speed from the forward second gear to the forward first gear.

6. The apparatus for controlling the angles of the working machine in accordance with any one of claim 2 to claim 4, further comprising:

a mode selecting means (42) which is connected to said controller (25), and allows the selection of any one of the automatic excavation modes in which at least one of the following is previously set; the bucket tilt angle corresponding to a predetermined boom ascent angle, and the bucket tilt period of time corresponding to the predetermined boom ascent angle.

7. The apparatus for controlling the angles of the working machine in accordance with any one of claim 2 to claim 4, further comprising:

a kick down switch (35) for shifting the traveling speed from the forward second car to the forward first gear; and a mode selecting means (42) which is connected to said controller (25), and allows the selection of any one of the automatic excavation modes in which at least one of the following is previously set; the bucket tilt angle corresponding to a predetermined boom ascent angle, and the bucket tilt period of time corresponding to the boom ascent angle.

8. The apparatus for controlling the angles of the working machine in accordance with claim 2 or claim 3, further comprising an engine speed detector (43) for detecting engine speed and outputting a detection signal to said controller (25)

said controller (25) selecting, the automatic excavation mode corresponding to the magnitude of a load determined based on said engine speed detection signal out of said stored automatic excavation modes, and controlling the movement of said bucket (4) based on said selected excavation mode.

* * * * *